US008107865B2

(12) United States Patent
Park

(10) Patent No.: US 8,107,865 B2
(45) **Date of Patent: *Jan. 31, 2012**

(54) IMAGE FORMING APPARATUS AND FIXING DEVICE

(75) Inventor: Seo-won Park, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/801,602

(22) Filed: Jun. 16, 2010

(65) Prior Publication Data

US 2010/0254735 A1 Oct. 7, 2010

Related U.S. Application Data

(63) Continuation of application No. 11/433,565, filed on May 15, 2006, now Pat. No. 7,761,043.

(30) Foreign Application Priority Data

Jun. 1, 2005 (KR) ..... 2005-46791

(51) Int. Cl.
*G03G 15/20* (2006.01)

(52) U.S. Cl. ..... 399/323; 399/124; 399/398

(58) Field of Classification Search ..... None
See application file for complete search history.

(56) References Cited

U.S. PATENT DOCUMENTS

| | | | |
|---|---|---|---|
| 4,475,804 | A | 10/1984 | Kanno et al. |
| 5,517,292 | A | 5/1996 | Yajima et al. |
| 5,708,926 | A | 1/1998 | Sagara et al. |
| 6,029,039 | A | 2/2000 | Aslam et al. |
| 6,205,316 | B1 | 3/2001 | Lida |
| 6,813,464 | B2 | 11/2004 | Amita et al. |
| 2005/0276638 | A1 | 12/2005 | Yamada |
| 2006/0182478 | A1 | 8/2006 | Miller et al. |

FOREIGN PATENT DOCUMENTS

| | | |
|---|---|---|
| JP | 04-052676 | 2/1992 |
| JP | 10-026900 | 1/1998 |
| JP | 2001-302055 | 10/2001 |
| JP | 2002-145503 | 5/2002 |

OTHER PUBLICATIONS

U.S. Appl. No. 11/443,565, filed May 16, 2006, Seo-won Park, Samsung Electronics Co., Ltd.
Office Action mailed Mar. 18, 2009 in file history of U.S. Appl. No. 11/433,565.
Office Action mailed Sep. 15, 2009 in file history of U.S. Appl. No. 11/433,565.
Notice of Allowance mailed Jun. 14, 2010 in file history of U.S. Appl. No. 11/433,565.

*Primary Examiner* — David Gray
*Assistant Examiner* — Roy Y Yi
(74) *Attorney, Agent, or Firm* — Staas & Halsey LLP

(57) ABSTRACT

An image forming apparatus including a fixing device having first and second rollers to press against each other with a sheet of paper to be transferred therebetween. The apparatus includes a roller frame to support the first roller; a separation claw, which, when disposed in an operational position on an outer circumferential surface of the first roller, separates the sheet of paper from the first roller; a claw frame to support the separation claw, which is movably attached to the roller frame to allow the separation claw to move between the operational position and a withdrawal position, at which the separation claw is withdrawn from the operational position; and an elastic member coupled between the claw frame and the roller frame, to bias the claw frame such that biasing force applied to the claw frame causes the separation claw to move from the withdrawal position to the operational position.

11 Claims, 4 Drawing Sheets

IMAGE FORMING APPARATUS AND FIXING DEVICE

CROSS-REFERENCE TO RELATED APPLICATIONS

This application is a continuation of application Ser. No. 11/433,565 filed May 15, 2006 now U.S. Pat. No 7,761,043 and claims the benefit of Korean Application No. 2005-46791, filed Jun. 1, 2005, in the Korean Intellectual Property Office, the disclosures of which are incorporated herein by reference.

BACKGROUND

1. Field

An aspect of the present invention relates to an image forming apparatus, and, more particularly, to an image forming apparatus which corrects a paper jam occurring in a fixing device without difficulty.

2. Description of the Related Art

Generally, an image forming apparatus comprises a paper feeding device, a developing device, a fixing device and a paper ejecting device. If the paper feeding device feeds a sheet of printing paper to the developing device, the developing device applies developer to the sheet of printing paper through a predetermined developing process. The fixing device receives the sheet of printing paper on which the developer is applied, from the developing device and fixes the developer to the sheet of printing paper. Then, the paper ejecting device ejects the sheet of paper on which the image is formed to the outside of the apparatus.

FIG. 1 is a front view of a conventional image forming apparatus. As shown in FIG. 1, the image forming apparatus comprises a fixing device 100. The fixing device 100 comprises a pressing roller 110 and a heating roller 120. The pressing roller 110 and the heating roller 120 rotate against and in opposition to each other to generate a moving path "P" for the sheet of printing paper therebetween. The pressing roller 110 applies pressure to the sheet of printing paper. The heating roller 120 comprises a heating part (not shown) to heat the sheet of printing paper and to fix the toner applied thereon. A roller frame 130 supports the heating roller 120.

The sheet of printing paper, which is pressed and heated, respectively, by the pressing roller 110 and the heating roller 120, passes between the pressing roller 110 and the heating roller 120 and is transformed by the heat of the heating roller 120 to curve around an outer circumferential surface of the heating roller 120.

However, the sheet of printing paper may adhere to the heating roller for too long a time and, therefore, may not be carried to a paper ejecting roller (not shown) properly. As such, the sheet of printing paper may not be discharged normally. Moreover, as the sheet of printing paper moves abnormally around the heating roller 120, once the sheet of printing paper gets between the heating roller 120 and the roller frame 130, the sheet of printing paper may be stuck between the heating roller 120 and the roller frame 130. When this happens, a paper jam occurs.

A separation claw 140 is provided in the fixing device 100 to prevent the sheet of printing paper from being curved and moving toward the heating roller 120. The separation claw 140 is disposed on the outer circumferential surface of the heating roller 120, along which the sheet of printing paper may be adhered to. In this position, the separation claw 140 separates the sheet of printing paper curved by the heat of the heating roller 120 from the heating roller 120, thereby inducing the sheet to move toward a normal moving path "P" thereof and to be supplied to the paper ejecting roller (not shown).

The separation claw 140 is supported by the roller frame 130 to be rotated by a claw hinge 142, which has an axis extending in a similar direction as that of the heating roller 120. A claw spring 144 is disposed between the separation claw 140 and the roller frame 130 to press the separation claw 140 with a predetermined amount of pressure so as to bias the separation claw 140 to adhere to the outer circumferential surface of the heating roller 120. The biased separation claw 140 is therefore prevented from being separated from the heating roller 120.

However, if the pressure of the claw spring 144 is lowered such that a gap is generated between the separation claw 140 and the heating roller 120, the sheet of printing paper transformed by heat may be not separated from the heating roller 120 by the separation claw 140 and may end up being stuck between the separation claw 140 and the heating roller 120. That is, a particular type of paper jam, known as an accordion type of paper jam, may occur.

As the separation claw 140 is adhered to the heating roller 120 with considerable pressure by the pressure exerted by the claw spring 144, the accordion type of paper jam is not easily corrected as compared to a typical type of paper jam. Accordingly, this type of paper jam may cause an inconvenience to a user, and the separation claw 140, the heating roller 120 and other surrounding devices may be damaged while a user corrects the paper jam, thereby raising the overall cost of repairs.

SUMMARY OF THE INVENTION

Accordingly, an aspect of the present invention provides an image forming apparatus and a fixing device which corrects a paper jam that occurs between a heating roller and a separation claw without difficulty.

Additional and/or other aspects and advantages of the invention will be set forth in part in the description which follows and, in part, will be obvious from the description, or may be learned by practice of the invention.

The foregoing and/or other aspects of the present invention are achieved by providing an image forming apparatus including a pressing roller and a heating roller to press against each other with a sheet of printing paper to be transferred there between, the apparatus comprising: a roller frame to support the heating roller; a separation claw, which, when disposed in an operational position on an outer circumferential surface of the heating roller, separates the sheet of printing paper from the heating roller; and a claw frame to support the separation claw, which is detachably attached to the roller frame to allow the separation claw to move between the operational position and a withdrawal position, at which the separation claw is withdrawn from the operational position.

According to an aspect of the present invention, the claw frame is coupled to the roller frame by a hinge.

According to an aspect of the present invention, the image forming apparatus further comprises an elastic member, which is disposed between the claw frame and the roller frame, to press the claw frame to bias the separation claw to move from the withdrawal position to the operational position.

The foregoing and/or other aspects of the present invention are achieved by providing a fixing device comprising a pressing roller to press a sheet of printing paper; a heating roller to rotate against the pressing roller, forming a moving path of the sheet of printing paper between the pressing roller and the heating roller, and to heat the sheet of printing paper; a roller frame to support the heating roller; a separation claw, which, when disposed in an operational position on an outer circumferential surface of the heating roller, separates the sheet of printing paper from the heating roller; and a claw, frame to support the separation claw, which is detachably attached to the roller frame to allow the separation claw to move between the operational position and a withdrawal position, at which the separation claw is withdrawn from the operational position.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
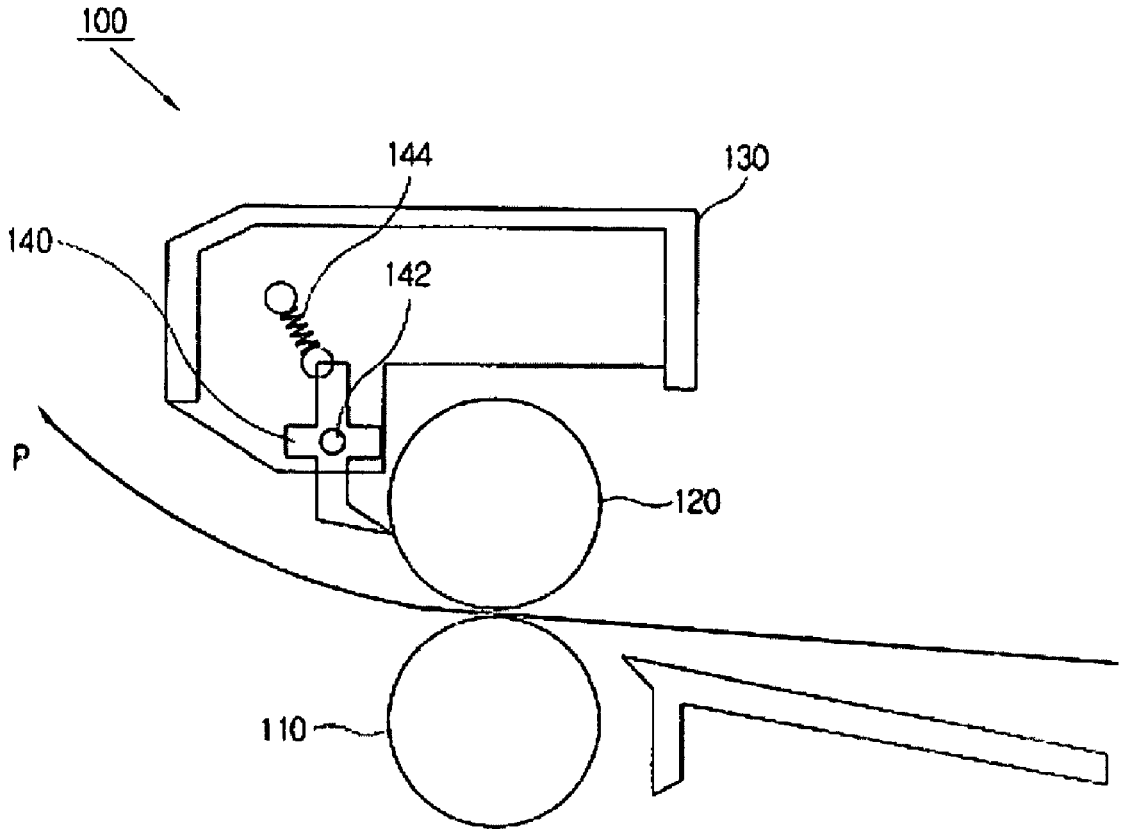
FIG. 1 (PRIOR ART)
FIG. 1 is a front view of a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
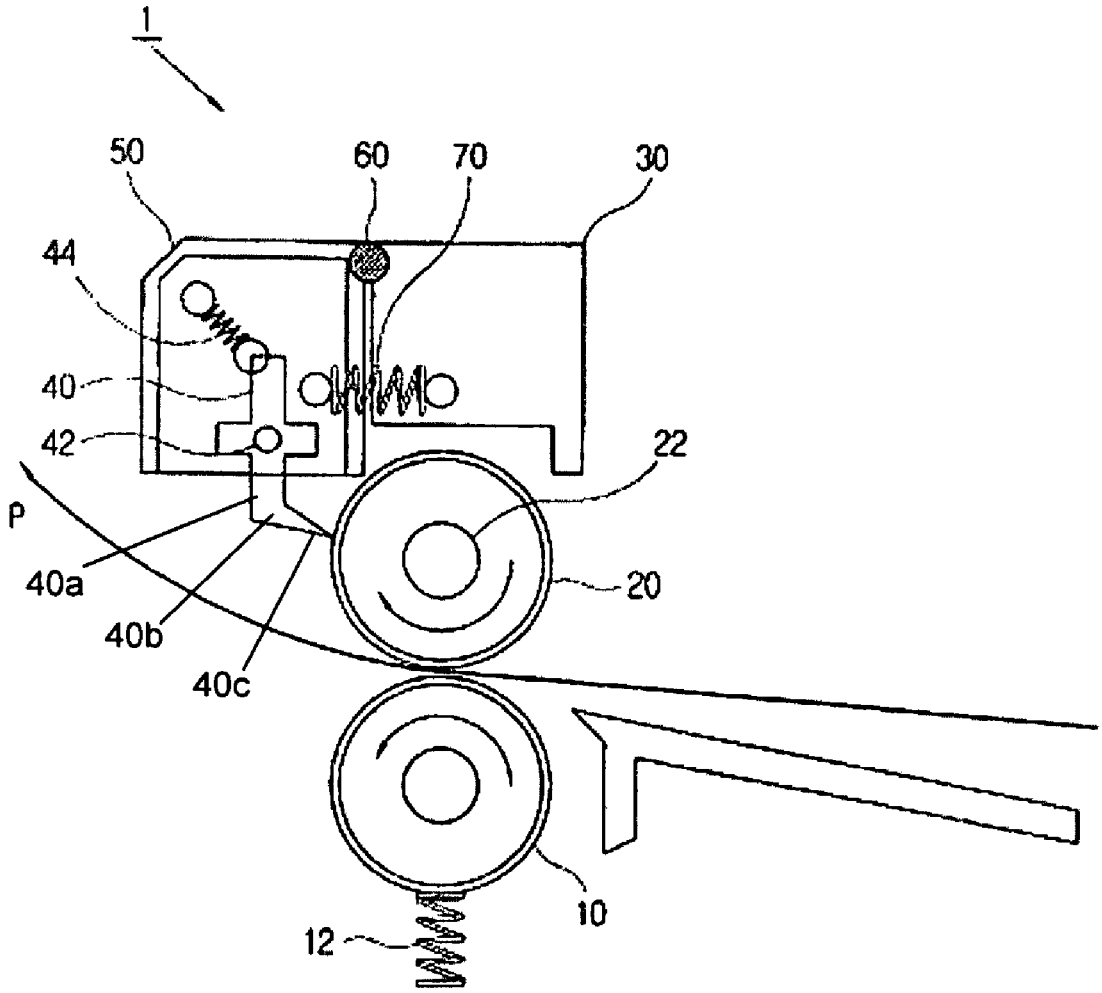
FIG. 2 is a front view of an image forming apparatus according to an embodiment of the present invention.
Figure 3:
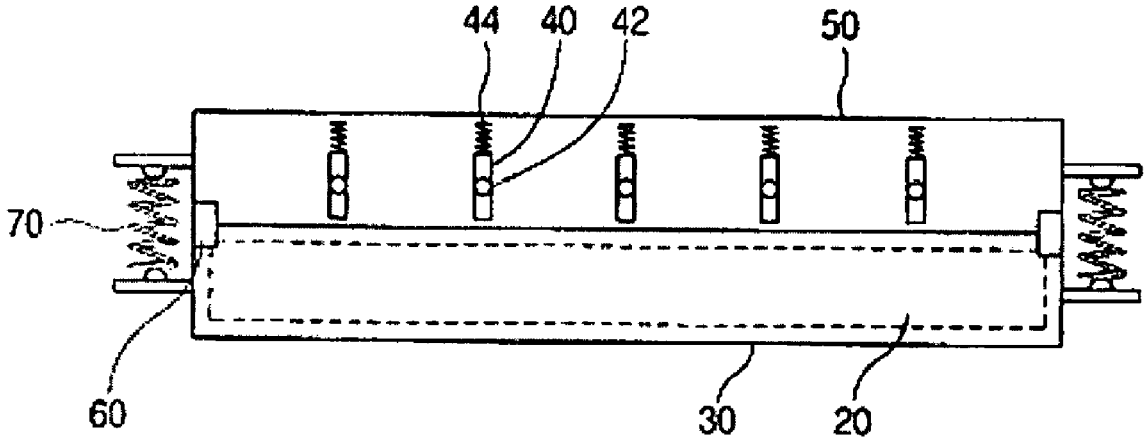
FIG. 3 is a plan view of the image forming apparatus in FIG. 2.

FIG. 2 is a front view of an image forming apparatus according to an embodiment of the present invention and FIG. 3 is a plan view of the image forming apparatus in FIG. 2. As shown in FIG. 2, the image forming apparatus comprises a paper feeding device (not shown), a developing device (not shown), a fixing device 1 and a paper ejecting device (not shown). The paper feeding device (not shown) feeds a sheet of printing paper to the developing device (not shown).

The developing device (not shown) comprises a photosensitive body (not shown) to apply developer to the sheet of printing paper through a predetermined developing process, thereby forming an image on the sheet of printing paper. The developing device (not shown) scans light toward a photosensitive body (not shown) to form an electrostatic latent image via a potential difference. Also, the developing device (not shown) selectively applies the developer to the electrostatic latent image to develop and transfer the image onto the sheet of printing paper.

The fixing device 1 receives the sheet of printing paper having had the developer from the developing device (not shown) applied thereon. The paper ejecting device (not shown) receives the sheet of printing paper from the fixing device 1 to discharge the sheet of printing paper to the outside of the image forming apparatus. The image forming apparatus may also comprise a printer, a photocopier, a facsimile, a multi-operational device, or combinations thereof.

The fixing device 1 comprises a pressing roller 10, a heating roller 20 and a separation claw 40. The pressing roller 10 and the heating roller 20 face each other and form a moving path "P" through which the sheet of printing paper may travel. The pressing roller 10 and the heating roller 20 rotate in opposition to each other to receive the sheet of printing paper from the developing device (not shown) and to carry the sheet of printing paper to the paper ejecting device (not shown).

The pressing roller 10 carries and presses the sheet of printing paper. A pressing part 12 presses the pressing roller 10 toward the heating roller 20 to make the pressing roller 10 press the sheet of printing paper. The pressing part 12 may comprise a spring or other pressing devices.

The heating roller 20 carries and heats the sheet of printing paper. A heater 22 receives a predetermined amount of electric power to heat the heating roller 20. The heater 22 may comprise a halogen lamp, a resistance heating body, etc. The heating roller 20, which is heated by the heater 22, dissolves the developer and fixes the dissolved developer to the sheet of printing paper.

The roller frame 30 supports the heating roller 20. The roller frame 30 may comprise a thermistor (not shown) which is disposed around the heating roller 20 to detect a heating temperature of the heating roller 20 so as to maintain a predetermined temperature of the heating roller 20; and a thermostat (not shown) to cut off power supplied to the heating roller 20 if the heating roller 20 is overheated.

The separation claw 40 is biased towards an outer circumferential surface of the heating roller 20 and separates the sheet of printing paper from the heating roller 20. After passing between the heating roller 20 and the pressing roller 10, the sheet of printing paper is transformed by heat to be curved and moves along the outer circumferential surface of the heating roller 20 in a circumferential direction. The separation claw 40, being in contact with the outer circumferential surface of the heating roller 20, separates the sheet of printing paper from the outer circumferential surface of the heating roller 20 and rectifies a moving direction of the sheet. The separation claw 40, therefore, enables the sheet of printing paper, which has passed between the heating roller 20 and the pressing roller 10, to be supplied to the paper ejecting device (not shown).

A claw frame 50 supports the separation claw 40 to bias the separation claw 40 toward the heating roller 20. The claw frame 50 comprises a claw hinge 42 and a claw spring 44. The separation claw 40 is rotatably supported by the claw hinge 42, an axis of which extends in a similar direction as that of the heating roller 20. The claw spring 44 is disposed between the claw frame 50 and the separation claw 40 and biases the separation claw 40 toward the outer circumferential surface of the heating roller 20. Thus, the separation claw 40 is able to maintain a predetermined operational position on the outer circumferential surface of the heating roller 20 and separates the sheet of printing paper from the heating roller 20 from this position.

In an embodiment of the invention, the separation claw comprises a first member 40*a* and a second member 40*b*. The first member 40*a* extends from the claw hinge 42 in a radial direction from the claw hinge 42. The second member 40*b* is connected to a distal end of the first member 40*a* and includes, in an embodiment of the invention, a claw point 40*c* that contacts the heating roller 20.

The claw frame 50 supports the separation claw 40 through the configuration shown in FIGS. 2 and 3. However, the configuration is not limited to that shown in FIGS. 2 and 3. As long as the claw frame 50 supports the separation claw 40 to bias the separation claw 40 toward the outer circumferential surface of the heating roller 20, the claw frame 50 may support the separation claw 40 through other configurations, as well as through the claw hinge 42 and the claw spring 44. That is, the claw spring 44 may act alone, without the claw hinge 42, to press the separation claw 40 toward the heating roller 20 to cause the separation claw 40 to adhere to the outer circumferential surface of the heating roller 20. Also, the claw frame 50 alone may press and support the separation claw 40 toward the heating roller 20 directly, without the need for the use of the claw hinge 42 and the claw spring 44.

The claw frame 50 is detachably attached to the roller frame 30 to allow the separation claw 40 to move between the operational position and a withdrawal position, at which the separation claw 40 is withdrawn from the operational position thereof. The claw frame 50 is rotatably coupled to the roller frame 30 by a frame hinge 60. An axis of the frame hinge 60 is parallel with that of the heating roller 20. Accordingly, the claw frame 50 rotates about the frame hinge 60 of the claw frame 50.

As the claw frame 50 rotates, the separation claw 40, supported by the claw frame 50, rotates as well. Concurrently, as the claw frame 50 rotates, the separation claw 40 also moves between the predetermined operational position where the separation claw 40 is biased toward the outer circumferential surface of the heating roller 20 so as to separate the sheet of printing paper from the heating roller 20, and the withdrawal position, at which the separation claw is spaced from the heating roller 20 and withdrawn from the operational position. Thus, a rotation of the claw frame 50 causes the separation claw 40 to be spaced from the heating roller 20, thereby generating a gap between the separation claw 40 and the heating roller 20.

As long as the separation claw 40 is withdrawn from the operational position, the frame hinge 60 comprises an axis that is parallel to an axis of the heating roller 20. Further, if the separation claw 40 is withdrawn from the operational position such that the claw frame 50 contacts the roller frame 30, the claw frame 50 may be detachably attached to the roller frame 30 by a coupling device such as a sliding coupling (i.e., a railing), as well as by a rotatable coupling.

The fixing device 1 comprises an elastic member 70. The elastic member 70 is disposed between the claw frame 50 and the roller frame 30. The elastic member 70 biases the claw frame 50 to move the separation claw 40 from the withdrawal position to the operational position. A first end of the elastic member 70 is supported by the claw frame 50, and a second end thereof is supported by the roller frame 30. If the claw frame 50 is rotated to dispose the separation claw in the withdrawal position, the elastic member 70 biases the claw frame 50 to induce the separation claw 40 to return to the operational position.

As shown in FIG. 3, the elastic member 70 may be disposed on both the claw frame 50 and the roller frame 30, but other embodiments, in which the elastic member 70 may be disposed in other positions, are possible.

The elastic member 70 has a predetermined elastic return force that does not cause the separation claw 40 to interfere with the rotation of the heating roller 20 by being overly biased toward the heating roller 20 when the separation claw 40 is in the operational position.

The fixing device 1 comprises a rotation stopper (not shown) to prevent the claw frame 50 from rotating more than a predetermined rotating angle if the separation claw 40 is withdrawn from the operational position. The fixing device 1 may further comprise a stopper (not shown) to prevent the claw frame 50 from over-rotating if the separation claw 40 occupies the operational position so that the separation claw 40 does not press the heating roller 20 with the additional force of the elastic return force caused by the elastic member 70. The rotation stopper (not shown) and the stopper (not shown) may be disposed between the claw frame 50 and the roller frame 30, or in other positions.

Figure 4:
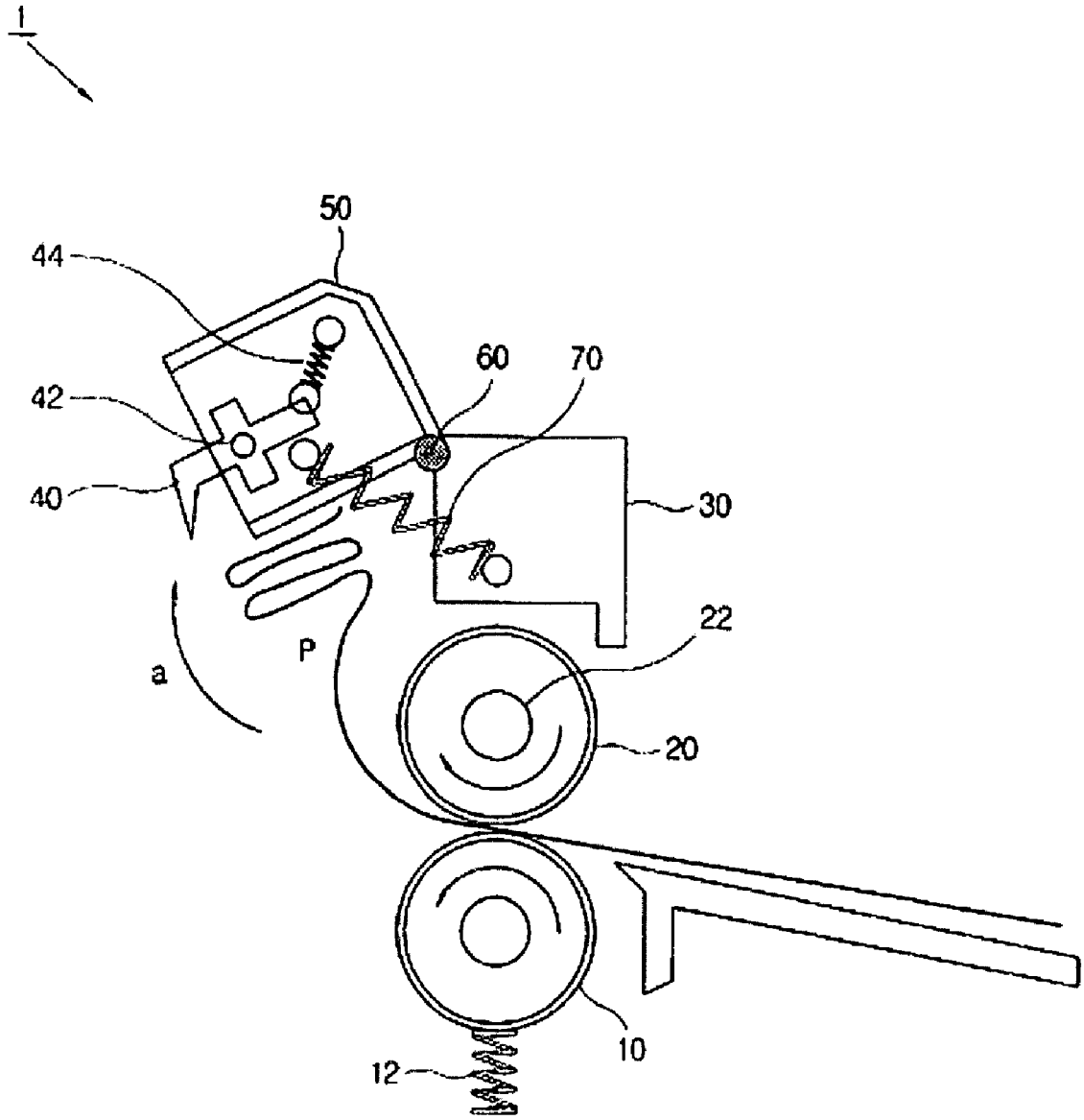
FIG. 4 is a front view to illustrate operation of the image forming apparatus in FIG. 2.

Hereinafter, the operation of the image forming apparatus, according to an embodiment of the present invention, will be described with reference to FIGS. 2 through 4.

FIG. 2 illustrates the separation claw 40 disposed in the operational position to perform the operation of separating the sheet of printing paper from the heating roller 20. FIG. 4 illustrates the separation claw 40 in a withdrawal position following a rotation of the claw frame 50.

The claw frame 50 is disposed in parallel with the roller frame 30 to dispose the separation claw 40 in the operational position and supports the separation claw 40. The separation claw 40 is biased toward the outer circumferential surface of the heating roller 20 by the pressure of the claw spring 44, and separates the sheet of printing paper from the heating roller 20.

If the sheet of printing paper is stuck between the separation claw 40 and the heating roller 20 as a result of the separation claw 40 failing to separate the sheet of printing paper, i.e., if an accordion type of paper jam occurs, a user may rotate the claw frame 50 in a direction "a" (see FIG. 4) around the frame hinge 60 to generate a gap between the separation claw 40 and the heating roller 20. Then, a user may remove the sheet of printing paper stuck between the separation claw 40 and the heating roller 20, and, then, return the claw frame 50 to an original position thereof.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus including a fixing device having a first roller and a second roller to press against each other with a sheet of printing paper to be transferred therebetween, the apparatus comprising:

a roller frame to support the first roller;

a separation claw, which, when disposed in an operational position on an outer circumferential surface of the first roller, serves to separate the sheet of printing paper from the first roller;

a claw frame to support the separation claw, which is movably attached to the roller frame to allow the separation claw to move between the operational position and a withdrawal position, at which the separation claw is withdrawn from the operational position, the claw frame being movably attached to the roller frame so as to enable a gravitational force applied to claw frame to pull the claw frame downward as the separation claw moves from the withdrawal position to the operational position; and an elastic member, which is coupled between the claw frame and the roller frame, to bias the claw frame such that a combination of biasing force applied to the claw frame and the gravitational force applied to the claw frame causes the separation claw to move from the withdrawal position to the operational position, wherein, the claw frame is movably attached to the roller frame such that the claw frame moves in a direction against the gravitational force applied to the claw frame as the separation claw moves from the operational position to the withdrawal position.

2. The image forming apparatus of claim 1, wherein the first roller comprises a heating roller and the second roller comprises a pressing roller.

3. The image forming apparatus of claim 1, wherein the first roller comprises a pressing roller and the second roller comprises a heating roller.

4. The image forming apparatus of claim 1, wherein the claw frame is coupled to the roller frame by a hinge.

5. The image forming apparatus of claim 4, wherein the claw frame comprises:

a claw hinge attached to the claw frame to rotatably support the separation claw; and a claw spring, disposed between the claw frame and the separation claw, to bias the separation claw toward the outer circumferential surface of the second roller.

6. The image forming apparatus of claim 5, wherein the separation claw comprises:

a first member extending from the claw hinge in a radial direction; and a second member, connected to a distal end of the first member, including a claw point to contact the second roller.

7. The image forming apparatus of claim 1, further comprising a frame hinge to couple the claw frame to the roller frame, an axis of the frame hinge being parallel with the second roller.

8. The image forming apparatus of claim 1, wherein the elastic member provides a predetermined elastic force to the claw frame to cause the separation claw to contact the second roller but not to interfere with the rotation of the second roller, when the separation claw occupies the operational position.

9. The image forming apparatus of claim 1, wherein the claw frame is disposed at upper side of the second roller and is configured to rotate with respect to a hinge through which an upper part of the claw frame and an upper part of the roller frame are coupled.

10. The image forming apparatus of claim 9, wherein the claw frame rotates clockwise with respect to the hinge to allow the separation claw to move from the operational position to the withdrawal position and rotates counterclockwise with respect to the hinge by an elastic force of the elastic member and a gravitation of the claw frame to return the separation claw to the operational position.

11. An image forming apparatus including a fixing device having a first roller and a second roller to press against each other with a sheet of printing paper to be transferred therebetween, the apparatus comprising:

a roller frame to support the first roller;

a separation claw, which, when disposed in an operational position on an outer circumferential surface of the first roller, serves to separate the sheet of printing paper from the first roller;

a claw frame to support the separation claw, which is movably attached to the roller frame to allow the separation claw to move between the operational position and a withdrawal position, at which the separation claw is withdrawn from the operational position; and an elastic member, which is coupled between the claw frame and the roller frame, to bias the claw frame such that biasing force applied to the claw frame causes the separation claw to move from the withdrawal position to the operational position, wherein no feed roller for feeding printing paper is supported by the claw frame.

* * * * *